United States Patent [19]

Segrott

[11] 4,266,838

[45] May 12, 1981

[54] PIN SOCKET

[75] Inventor: Leslie Segrott, New Cumberland, Pa.

[73] Assignee: E. I. Du Pont de Nemours and Company, Wilmington, Del.

[21] Appl. No.: 82,551

[22] Filed: Oct. 9, 1979

Related U.S. Application Data

[63] Continuation-in-part of Ser. No. 871,684, Jan. 23, 1978, abandoned.

[51] Int. Cl.[3] ..... H01R 9/09

[52] U.S. Cl. ..... 339/17 C; 339/275 B

[58] Field of Search ..... 339/17 C, 17 D, 17 LC, 339/275 R, 275 B, 128, 220 R

[56] References Cited

U.S. PATENT DOCUMENTS

| | | | |
|---|---|---|---|
| 1,987,035 | 1/1935 | Tideman | 339/128 |
| 2,167,270 | 7/1939 | Woodward | 339/128 |
| 2,911,575 | 11/1959 | Roberts | 339/128 |
| 3,230,297 | 1/1966 | Means | 339/275 B |
| 3,233,034 | 2/1966 | Grabbe | 339/278 C |
| 3,268,851 | 8/1966 | Mancini | 339/258 |
| 3,614,713 | 10/1971 | Heath | 339/128 |
| 3,784,965 | 1/1974 | Murphy | 339/17 C |
| 3,899,232 | 8/1975 | Berg | 339/17 C |
| 4,037,899 | 7/1977 | Crowell | 339/17 C |
| 4,070,077 | 1/1978 | Clark | 339/17 C |

FOREIGN PATENT DOCUMENTS

| | | | |
|---|---|---|---|
| 231237 | 7/1959 | Australia | 339/128 |
| 1123304 | 8/1968 | United Kingdom | 339/17 D |

*Primary Examiner*—Neil Abrams

[57] ABSTRACT

A circuit board pin socket having an eyelet defined by an elongate hollow conductive metal body with an inside surface suitable for electrical contact with a male pin member. A plug of heat-resistant polymeric material extends through and fills the inside of the eyelet for protection thereof during fluxing and subsequent wave soldering of the socket to a printed circuit board. The socket has at least three angularly disposed spring arms which extend from an end of the eyelet and operate to position the socket in a circuit board hole.

7 Claims, 8 Drawing Figures

PIN SOCKET

This application is a continuation-in-part of my application Ser. No. 871,684, filed Jan. 23, 1978 now abandoned.

BACKGROUND OF THE INVENTION

This invention relates to the field of circuit board pin sockets, and more particularly, to the type having apertures at both ends of the socket body for permitting an inserted male pin member to extend through and beyond the body.

Circuit board pin sockets of the latter type have been described in U.S. Pat. Nos. 3,899,232 and 4,037,899 issued to Berg and Crowell, respectively. Such sockets are inserted and staked into holes in printed circuit boards and soldered thereto by wave soldering processes. Prior to soldering, the portions to be soldered are fluxed to remove oxides which interfere with soldering. During soldering, one side of a socket-carrying circuit board is moved across a molten wave of solder to provide for solder flow into the space between the socket body and the circuit board hole. As contamination by flux and solder is deleterious to the achievement of a good quality electrical contact with the inside of the eyelet, various means have been utilized to avoid flux and solder contamination. For example, penetrable silicone rubber seals have been used for this purpose, as described in the above-referenced U.S. Pat. No. 3,899,232. Also used for this purpose are plastic inserts, generally of Teflon®, as disclosed in U.S. Pat. No. 3,268,851 issued to Mancini.

SUMMARY OF THE INVENTION

According to the present invention, the circuit board pin socket has at least three equally spaced spring arms which extend from one end of an eyelet. The eyelet is defined by an elongate hollow body formed of conductive metal. Each spring arm is disposed at an acute angle to the eyelet body by means of a reverse bend. The inside surface of the eyelet body is adapted for electrical contact with a male pin member designed to be inserted therein.

A removable plug of heat-resistant polymeric material extends through and fills the body of the eyelet, contacting the inside surface of the eyelet for protection thereof from flux and solder contamination during wave soldering of the socket to a printed circuit board. The polymeric plug can be removed by either the insertion of the male pin member for which the socket is designed, or by a secondary operation during manufacture. By extending completely through the eyelet, the plug protects both ends of the socket, thus eliminating the requirement of a drawn or stamp-formed body with a closed metal end. Although the open-seam design of the socket of this invention permits flux and solder to wick up into and through the seam, the plug prevents contamination of the inside contact area of the eyelet.

Other features of this invention will become apparent from the Detailed Description of the Invention wherein reference is made to the accompanying drawings, next described.

DETAILED DESCRIPTION OF THE INVENTION

Figure 1:
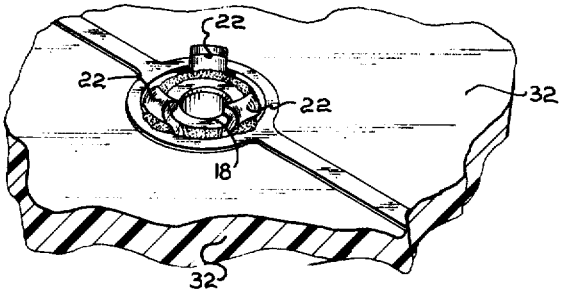
FIG. 1 is a perspective view of a portion of a printed circuit board containing therein a preferred embodiment of the socket of this invention.

A preferred embodiment of the circuit board socket is as shown in FIGS. 1-8 and also as described herein below, wherein corresponding reference numerals are used throughout to identify the various elements.

Figure 2:
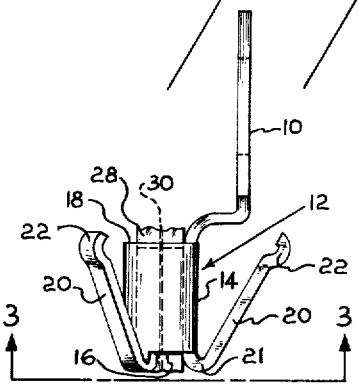
FIG. 2 is an elevation view of the socket shown in FIG. 1, but shown attached to a carrier strip prior to insertion into a printed circuit board.
Figure 4:
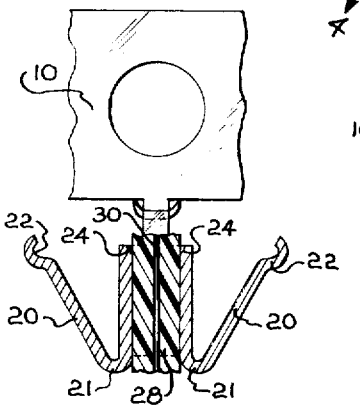
FIG. 4 is an off-set cross-section along lines 4—4 of FIG. 3, and includes a front view of the carrier strip.
Figure 3:
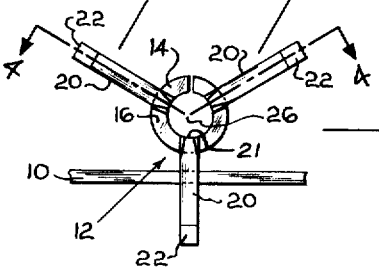
FIG. 3 is an end view of the socket along lines 3—3 of FIG. 2.
Figure 5:
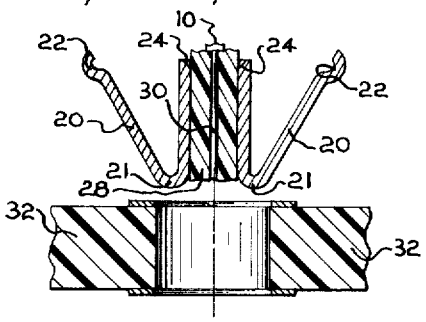
FIG. 5 is a sectional view of the socket also along section lines 4—4 immediately prior to insertion into a printed circuit board.

Shown attached to carrier strip 10 in FIG. 2, the circuit board socket 12 has an eyelet 14 defined by an elongate hollow conductive metal body having a generally cylindrical configuration as also shown in FIG. 3. The socket is fabricated from flat thin conductive metal stock, preferably copper-nickel alloy, via use of a progressive die. Prior to die stamping, the metal is gold flashed and the portion of metal which will comprise the inside of the eyelet is gold-plated. Also prior to stamping, solder resist is applied to selective portions of the metal as described hereinafter.

Eyelet 14 has a first open end 16 and a second open end 18. Extending from first end 16 are three equally spaced spring arms 20. Each of the spring arms has a reverse bend 21 away from end 16 and has a portion thereby disposed at an acute angle to the eyelet 14. In the preferred embodiment of the socket, the spring arms 20 have inwardly hooked ends 22. The portion of the spring arm 20 which is disposed at an acute angle to the eyelet 14 must have a greater physical length than the eyelet. Thus when the socket 12 is inserted into the circuit board 32, the inwardly-hooked ends 22 extend above the board surface thereby providing mechanical retention of the socket in the board as depicted in FIG. 1. The use of three spring arms as opposed to two provides for truer vertical positioning of the socket in the circuit board. The same feature also contributes to squareness of socket alignment in the circuit board plane.

Figure 6:
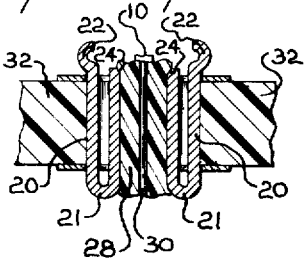
FIG. 6 is a sectional view along lines 4—4 of the socket following its insertion into the circuit board.

Also in the preferred embodiment, the second end 18 of the eyelet 14 is chamfered along its inside edge 24 as shown in FIG. 6. Chamfering provides for easier insertion of a male pin member, and can be accomplished as one of the progressive die steps.

As mentioned, solder resist is applied to selective portions of the stamped conductive metal prior to the progressive die steps. In the preferred embodiment, solder resist is applied to the reverse bend areas 21 of spring arms 20. The solder resist operates as an aid to prevent solder from adhering to and thus interfering with the lead-in area to the gold-plated eyelet passageway 26 (FIG. 3). Protection of the plated eyelet passageway 26 is afforded by a removable plug 28 (FIG. 2) of heat-resistant polymeric material which extends through and fills the eyelet 14 during the soldering process. In the preferred embodiment, the plug 28 is of Teflon ® flurocarbon resin-coated wire. (Teflon ® is a registered trademark of E. I. duPont de Nemours & Co.) The wire forms a core center 30 as shown.

Figure 7:
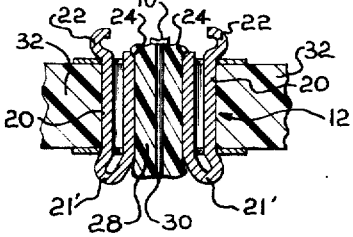
FIG. 7 is a sectional view along lines 4—4 of the socket inserted and staked into the circuit board.
Figure 8:
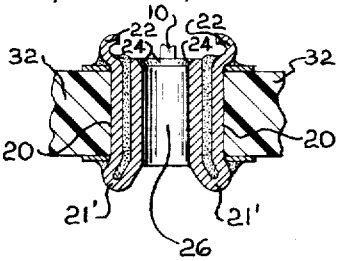
FIG. 8 is a sectional view along lines 4—4 of the socket inserted, staked and soldered to the circuit board, with the plug removed.

Following fabrication, the socket may be inserted into a printed circuit board as depicted by the sequence of FIGS. 5 through 8. After insertion is completed, as per FIG. 6, the socket 12 may be staked as shown in FIG. 7, wherein the reverse bends are expanded outwardly to the staked position shown at 21' to provide for mechanical securement to the board 32. The staked socket may then be soldered to the board as shown in the sectional view of FIG. 8, and in the perspective view of FIG. 1.

I claim:

1. A circuit board socket comprising:

(a) an eyelet, said eyelet defined by an elongate hollow conductive metal body having a generally cylindrical configuration, the body having open first and second ends, (b) at least three spaced-apart spring arms extending from said first end of the eyelet, each arm having a reverse bend away from said first end forming an acute angle with the eyelet body, each of said arms having a greater physical length than the eyelet so that each arm protrudes above the eyelet when the eyelet is mounted in a circuit board, (c) each spring arm portion forming the acute angle with the eyelet body being straight except for inwardly hooked ends located adjacent the second end of the eyelet when mounted in a circuit board to insure mechanical retention of the socket in the circuit board.

2. The socket of claim 1 wherein a removable plug of heat-resistant polymeric material extends through and fills the eyelet.

3. The socket of claim 1 wherein the second end of the eyelet is chamfered along its inside edge.

4. The socket of claim 2 wherein the removable plug is a flurocarbon resin-coated wire.

5. The socket of claim 1 wherein the conductive metal is of copper-nickel alloy.

6. The socket of claim 1 wherein the inside of the eyelet is gold plated.

7. The socket of claim 1 wherein a layer of solder resist is adherent to said reverse bend portion of each arm.

* * * * *